US008239124B2

(12) United States Patent
Yamane

(10) Patent No.: US 8,239,124 B2
(45) Date of Patent: Aug. 7, 2012

(54) TRAFFIC INFORMATION PROVIDING SYSTEM AND METHOD FOR GENERATING TRAFFIC INFORMATION

(75) Inventor: Kenichiro Yamane, Paris (FR)

(73) Assignee: Xanavi Informatics Corporation, Zama-shi (JP)

( * ) Notice: Subject to any disclaimer, the term of this patent is extended or adjusted under 35 U.S.C. 154(b) by 953 days.

(21) Appl. No.: 12/138,174

(22) Filed: Jun. 12, 2008

(65) Prior Publication Data

US 2008/0312811 A1 Dec. 18, 2008

(30) Foreign Application Priority Data

Jun. 15, 2007 (EP) ..... 07011785

(51) Int. Cl.
*G06G 7/76* (2006.01)
*G08G 1/00* (2006.01)
*G08G 1/01* (2006.01)

(52) U.S. Cl. ..... 701/118; 701/119

(58) Field of Classification Search ..... 701/118, 701/119, 117; 340/933, 934, 936
See application file for complete search history.

(56) References Cited

U.S. PATENT DOCUMENTS

| | | | | |
|---|---|---|---|---|
| 6,195,611 | B1 * | 2/2001 | Sakamoto et al. | 701/209 |
| 7,908,076 | B2 * | 3/2011 | Downs et al. | 701/117 |
| 2002/0026278 | A1 | 2/2002 | Feldman | |
| 2005/0093720 | A1 | 5/2005 | Yamane et al. | |
| 2011/0173015 | A1 * | 7/2011 | Chapman et al. | 705/1.1 |

FOREIGN PATENT DOCUMENTS

| | | | |
|---|---|---|---|
| EP | 1 489 576 | A1 | 12/2004 |
| JP | 7-129893 | A | 5/1995 |
| JP | 2002-260142 | A | 9/2002 |
| WO | WO 02/089089 | A1 | 11/2002 |
| WO | WO 2007/077472 | A1 | 7/2007 |

OTHER PUBLICATIONS

V. Coscia et al., "On the mathematical theory of vehicular traffic flow II: Discrete velocity kinetic models", International Journal of Non-Linear Mechanics, Pergamon press, 2007, pp. 411-421, vol. 42, No. 3.

S. Vaton et al., "Network Traffic Matrix: how can one learn the prior distributions from the link counts only?", Communications, IEEE Communications on Paris, 2004, pp. 2138-2142.

Office Action in European Patent Application No. 07 011 785.8-2215 dated Mar. 25, 2011.

* cited by examiner

*Primary Examiner* — Mark Beauchaine
(74) *Attorney, Agent, or Firm* — Crowell & Moring LLP

(57) ABSTRACT

The invention relates to a method for generating traffic information to be used in a car navigation system, comprising the steps of acquiring traffic information data including information relating to a travel time of links making up a road on a map and for acquiring map data relating to the link, the map data comprising at least information on a road type of the link and checking if a volume of the traffic information data available in is sufficient for performing a statistical estimate for the travel time. In order to enhance the traffic information generated, it is proposed to use the steps of checking if the volume of traffic information data relating to links located in a target area is sufficient and adapting a size of the target area depending on the amount of available traffic information data.

11 Claims, 5 Drawing Sheets

TRAFFIC INFORMATION PROVIDING SYSTEM AND METHOD FOR GENERATING TRAFFIC INFORMATION

BACKGROUND OF THE INVENTION

The present invention relates to a traffic information providing system for creating traffic information to be used in a car navigation system. In particular, the invention relates to a traffic information providing system suitable for generating traffic information relating to free traffic flow conditions. Moreover, the invention relates to a method for generating traffic information to be used in a car navigation system, a data storage device storing traffic information generated according to the method of the invention and to a car navigation system comprising such a data storage device.

The document US2005/0093720A1 teaches a traffic information providing system for creating traffic information to be used in a car navigation system. The traffic information providing system comprises a unit for getting traffic information data relating to a travel time of links making up a road on a map. The data getting unit moreover acquires map data relating to the link, wherein the map data comprises e.g. information on the road type of the link, on a length of the link and on the coordinates of endpoints of the link. The system according to US2005/0093720A1 teaches to delete abnormal data when there is an abnormality in the acquired traffic information and to apply a statistical processing for calculating a probability distribution of travel times of links making up the entire route and to calculate a probability for a specific travel time range. If no traffic information is provided for a specific link, the travel time associated to such link is estimated either based on a congestion degree and a congestion link of the non-provision link or estimates the travel time associated to the link based on traffic information of links in the vicinity of the non-provision link. The latter estimate uses traffic information relating to links within a predetermined distance of e.g. 2 kilometers.

In a technique disclosed in JP-A-7-129893, the average vehicle speed of a link where no traffic information is provided is calculated based on traffic jam or congestion information included in external information. The complementary information for the non-provision link is calculated based on a calculated average vehicle speed and the travel time for the link is also estimated based on the average vehicle speeds at specific times of the day or at specific days of the week (e.g. holidays, work days, etc.). The technique disclosed in JP-A-7-129893 is intended to be applied a for vehicle route guiding system. However, traffic information is updated from moment to moment, and when traffic information data received are also included in the traffic information database used for calculating the average, a required memory capacity and correspondingly a required processor capacity becomes enormous. In such a vehicle route guiding system, it is difficult to estimate a travel time of a non-provision link on a real-time basis, since the memory capacity and the processing performance are limited. In addition, it is very inefficient to perform the same data processing procedures for individual vehicle route guiding systems over and over again.

The document JP-A-2002-260142 discloses a technique where data about runtimes of a road section including the road in question are collected and stored in a runtime memory table having runtime data base where runtime data are collected. In order to estimate a runtime, the runtime memory table is searched for a pattern similar in runtime and a runtime memory value for the similar pattern found is used as a predicted runtime. By repeating such operations, a plurality of candidates of the predicted runtime are found. In the technique disclosed in JP-A-2002-260142, even when a prediction error within a given probability is found, the error may fail to fall in a practical range. For example, the prediction error within a probability of 90% may become larger than a mean value of the probability distribution of travel times, such that the thus acquired statistical information is not of any practical use.

In general, the estimation of travel times or links where no traffic data is provided is performed based on either road traffic sensor data or on the use of limiting speed data. Since the road traffic sensors are managed by public authorities, it is generally difficult to get such data. The limiting speed data are rarely provided in map data. However, map data and traffic information data often include average travel times relating to a specific link. Conventional traffic information providing systems therefore often use the average travel times provided by the data providers as an estimate for the travel time under free traffic conditions for links where no detailed traffic information is provided. However, the average travel times provided in the map data are often of poor quality, such that the estimates based on such average travel times often suffer from large estimation errors. Since the travel time estimates for free traffic flow are often used as a basis for estimates under congested conditions, the estimation error will be propagated to further processing steps and tends to increase.

In view of the above, it is very important to provide a precise estimate of the travel times under free traffic flow conditions at e.g. midnight as a sound basis for further estimation procedures using the latter travel time estimate or free traffic flow conditions.

SUMMARY OF THE INVENTION

One of the objects of the invention is to provide a traffic information providing system for creating traffic information to be used in a car navigation system which accurately estimates the travel speeds in free traffic flow conditions, using both real traffic data and map data. Moreover, the invention seeks to avoid the use of externally provided average travel speed data provided by map data providers as far as possible.

According to one aspect of the invention, the invention starts from a traffic information providing system for creating traffic information to be used in a car navigation system. The traffic information providing system comprises a data getting unit for acquiring traffic information data including information relating to a travel time of links making up a road on a map and for acquiring map data relating to the link. The map data may comprise at least information on a road type of the link and may further comprise information on a length and on the coordinates of the starting point and of the endpoint of the link. The information on the road type may include information on the number of lanes of the road making up the link. Moreover, the traffic information providing system comprises a data volume check unit for checking if a volume of the traffic information data available is sufficient for performing a statistical estimate for the travel time.

In particular, the invention proposes to configure the data volume check unit in a way that the data volume check unit checks the volume of traffic information data relating to links located in a target area and to adapt a size of the target area depending on the amount of available traffic information data. Due to this configuration, the size of the target area can always be suitably chosen, such that the volume of available data relating to the links located in the chosen target area is sufficient to achieve a trustworthy prediction while the target area is still small enough to account for the regional variations in the traffic conditions.

According to a further aspect of the invention, it is proposed that the data volume check unit is configured to increase the size of the target area, if a volume of traffic information data relating to links located in a previously chosen target is insufficient. Due to this configuration, the size of the target area can be stepwise adapted starting from low values, such that an excessively large target area can be surely avoided.

If the traffic information providing system comprises a speed processing unit for determining the travel speed of a specific link by evaluating the traffic information data relating to links of the same or similar road type and being located in the same target area as the specific link, erroneous estimates due to a mixing of different road types can be avoided. The road type may be differentiated according to the number of lanes.

Moreover, it is proposed that the speed processing unit is configured to select a predetermined percentile speed from a distribution of speed values of speed values extracted from the traffic information data, wherein the speed values are relating to links of the same or similar road type and wherein the links are located in the same target area as the specific link. Moreover, the speed processing unit may be configured to set the value of a tentative speed of the specific links equal to the value of the predetermined percentile speed. If a percentile speed is selected, the influence of single abnormal data points may be weakened as compared to approaches where the tentative speed is selected based on an average and/or variance of the distribution of speed values.

It has turned out that very viable predictions can be achieved if the predetermined percentile speed is higher than the $60^{th}$ percentile speed. Favorably, the predetermined percentile speed is between the $80^{th}$ and $90^{th}$ percentile speed. Most favorably, the predetermined percentile speed is chosen as the $85^{th}$ percentile speed of all the speed data arranged in an ascending order. In order to the percentile speed, all the speed data are ordered in an ascending or descending order and the number of the available speed data points is determined. The total number of available speed data points is multiplied with a factor between 0 and 1, corresponding to the predetermined percentile value and the result is rounded up or down to the next integer value. The speed value according to the rank of the thus determined integer value is selected.

Furthermore, it is proposed that the traffic information providing system is provided with a speed compensation unit being configured to calculate a speed value for a specific link dependent on a tentative speed value determined from a distribution of speed values. The distribution of speed values may be extracted from the traffic information data and/or from a data base of previously stored speed values. The speed compensation unit may calculate the speed value for the specific link by applying at least one correction function to the tentative speed value. It has turned out that estimates being directly based on the statistics and/or on the tentative value suffer from estimation errors being, among others, due to an erroneous measurement of traffic sensors and to erroneous data in the traffic information data. By selecting suitable speed compensation methods, the viability of the speed estimates may be highly increased.

In particular, it is proposed that the correction function is a monotonically increasing function with values between a lower speed limit and an upper speed limit. Such a correction function may filter out speed values beyond the upper speed limit and below the lower speed limit. Excessively low speed values may be due to errors in the speed measurement, e.g. if a car is illegally parking within the range of a speed sensor. Other errors in the traffic information data generating methods may lead to excessively high speed values, which may be cut off using the upper speed limit.

A corruption of viable speed data between the lower speed limit and the upper speed limit may be avoided if the correction function is equal to the identity function for values of the tentative speed between a first threshold and the upper speed limit. The first threshold may correspond to the lower speed limit.

A very simple and fast correction of the speed data may be achieved if the correction function is a piecewise linear function.

According to a further aspect of the invention, it is proposed that the speed compensation unit is configured to calculate a characteristic value for a road density within an area comprising the specific link and to determine the correction function depending on the characteristic value. It has turned out, that the road density of an area a route passes through strongly influences the travel time. A higher road density leads to a longer travel time and vice versa. Therefore, it is favorable to slightly augment the travel time estimates for areas with higher road density and to decrease the travel times for areas with lower road density. If such an approach is chosen, a route search algorithm using the traffic information data generated by the traffic information providing system according to the invention will tend to avoid areas with higher route density. The finally calculated route will circumvent such areas, which leads to a better result in the time estimates and to an increased driving comfort for the driver. In view of the above, it is particularly favorable, if the correction function has a slope that decreases when the road density decreases.

Moreover, it is proposed that the speed compensation unit is configured to consequently apply at least a first correction function and a second correction function to the tentative speed value. The different correction functions may account for different sources of estimation errors.

If the traffic information providing system comprises a speed adjustment unit being configured to compare average speeds of different road types within the same area and to adjust the average speeds if the comparison yields to an unexpected result, contradictions in the estimated speeds may be avoided. If e.g. the speed estimate for interstate highways is lower than the speed estimates for smaller streets, the route search algorithm using the data would avoid interstate highways in favour of other road types and wrong travel time estimates would be generated. The different road types may be arranged according to the predetermined speed rank order for a given number of lanes. The road types may include international and intercity motorways, national motorways, international and intercity highways, national and other highways, district roads, arterial roads, basic roads and ferry routes.

If the speed adjustment unit is configured to determine the ratio of the adjusted average speed and the original average speed for each road type and to adjust the speed values for each link of the same road type in the same area by multiplying it with the thus determined ratio, the adjustment of the average speeds may be propagated to the speed values of the individual links.

According to a further aspect of the invention, the method for generating traffic information to be used in a car navigation system is proposed. The method comprises the steps of acquiring traffic information data including information relating to a travel time of links making up a road on a map and for acquiring map data relating to the link. The map data comprises at least information on a road type of the link and may comprise further information, e.g. on the length of the links and on coordinates of endpoints of the link.

The method further comprises the step of checking if a volume of the traffic information data available is sufficient for performing a statistical estimate for the travel time. According to the invention, the step of checking if the volume of the traffic information data relating to links located in a target area is sufficient comprises adapting a size of the target area depending on the amount of available traffic information data. According to the above described method, the target area may be chosen always in an optimal way such that it is sufficiently large to perform a viable statistical analysis on the one hand and that on the other hand smaller length scale variations in the traffic characteristics are kept as far as possible.

According to a further aspect of the invention, it is proposed to provide a data storage device, which may be formed e.g. as a hard disc drive or as an optical disk, wherein the data storage device comprises traffic information generated according to the above mentioned method.

Finally, according to a further aspect of the invention, it is proposed to provide a car navigation system comprising a storage device of the above described type, wherein traffic information is generated according to the above method are stored.

Furthermore, it is proposed to provide a car navigation system or a truck planning system performing at least one of the steps of the method according to the invention. In particular, the speed compensation could be performed by a speed compensation unit located of the car navigation system, wherein the car navigation system reads traffic information data as output by the statistical processing step.

Further objects and advantages of the invention will become apparent from the following description of schematic drawings. The description and the drawings illustrate a specific embodiment of the invention combining a multitude of features, the merits of which will be appreciated by the skilled person individually or in other suitable combinations. The specific embodiment as described below is not intended to limit the general idea of the invention.

DETAILED DESCRIPTION OF THE EMBODIMENTS

Figure 1:
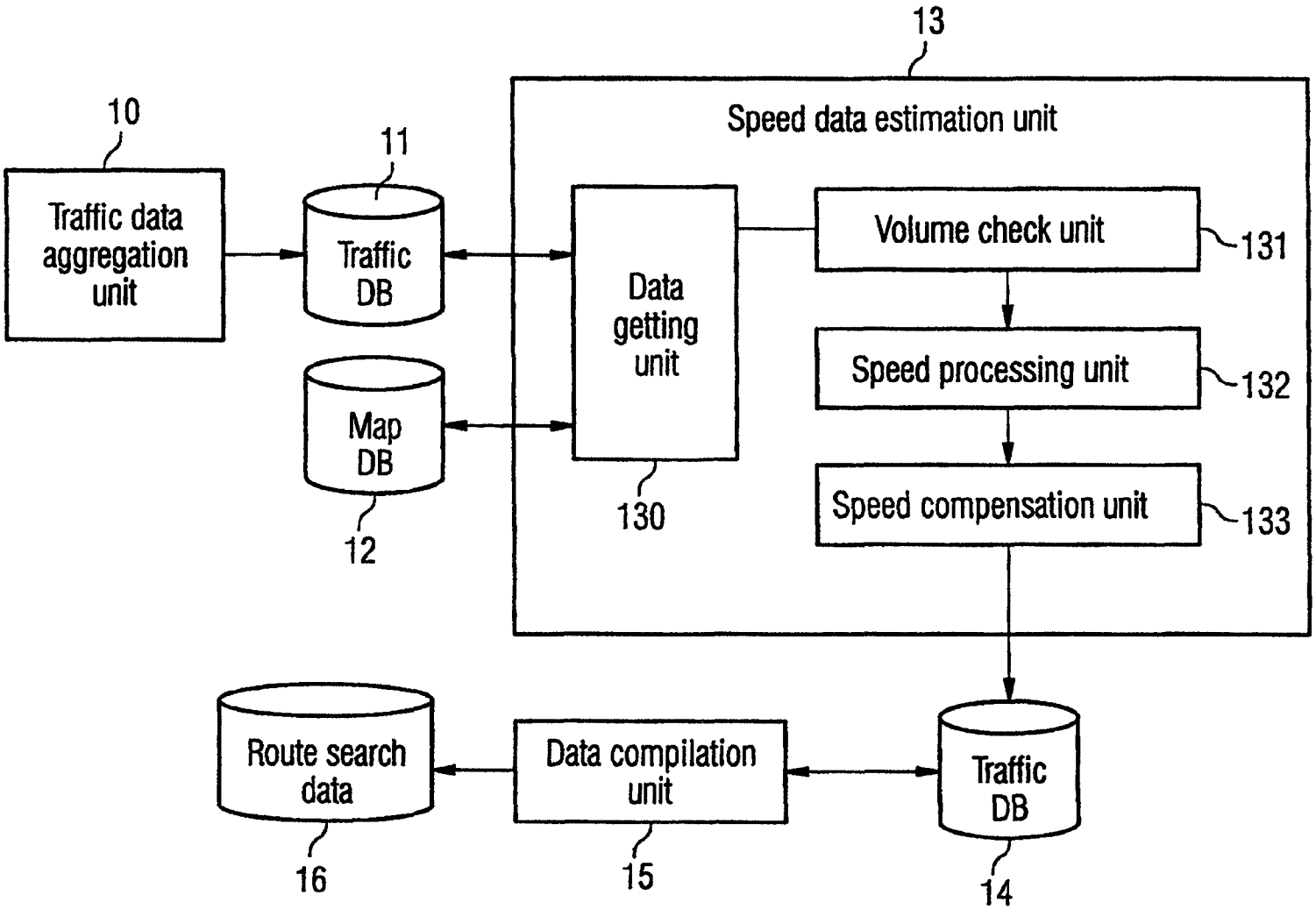
FIG. 1 is a block diagram of the traffic information providing system according to the invention.

FIG. 1 is a schematic representation of a traffic information providing system for creating traffic information to be used in a car navigation system. The traffic information providing system comprises a speed data estimation unit 13 which processes traffic information data acquired from a traffic data base 11 and map data acquired from a map data base 12. The traffic information storage in the traffic data base 11 is provided by a traffic data aggregation unit 10.

The speed data estimation unit 13 processes the information in order to obtain speed data 14. The speed data is a data structure where links forming a map are associated with predetermined travel speeds or travel times. The speed data 14 estimated by the speed data estimation unit 13 is compiled by a data compilation unit 15 and subsequently stored in a storage device 16 comprising route search data. The route search data is traffic information which is usable by a car navigation system, in order to perform a route search. The car navigation system uses well-known route search algorithms in order to find an optimum route from a starting point to an endpoint, wherein at least one optimization criterion is the travel time. The travel time for a given route is calculated by the car navigation system as a sum of the travel times associated to the links making up the route.

In order to obtain the traffic information data and the map data, the speed data estimation unit 13 comprises a data getting unit 130 for acquiring the traffic information data and the map data. The traffic information data comprises a large number of sample travel times associated to the links making up the map. Moreover, the traffic information data may include live data such as data relating to traffic congestions, accidents, etc.

The map data is data representing a road map, wherein the road map is divided into level 1 and level 2 meshes, wherein each mesh includes typically more than one link and more than one road. The links within the meshes are stored as data structures comprising a link identification number, an identification of the mesh comprising the link, coordinates of the staring points and endpoints of the links, a length of the link and an average travel time associated to the link.

The data obtained by the data getting unit 130 is processed in a series of steps by a data volume check unit 131, a statistical unit 132 and a speed compensation unit 133, in order to obtain the speed data. The speed data includes travel speeds from every link for every time span of a day and for different types of days (e.g. holidays, work days).

In the embodiment described herein after, the method according to the invention is applied to estimate travel speeds and/or travel times for links where no sufficient traffic data is available for immediately determining the travel speed or the travel times from a statistical processing. In practice, real traffic data can be obtained from the traffic data aggregation unit 10 only for major arterial roads and motorways or highways at a sufficient extent, whereas no real traffic data is available for the majority of smaller district roads or less important road sections. The invention is mainly concerned with estimating the travel speed for the links where no real traffic data is provided under free traffic flow conditions. The travel times for congested conditions may be estimated based on the estimate for free traffic flow conditions, using other known methods.

The processing of the data volume check unit 131, the speed processing unit 132 and the speed compensation unit 133 is described in more detail with reference to FIG. 2.

Figure 2:
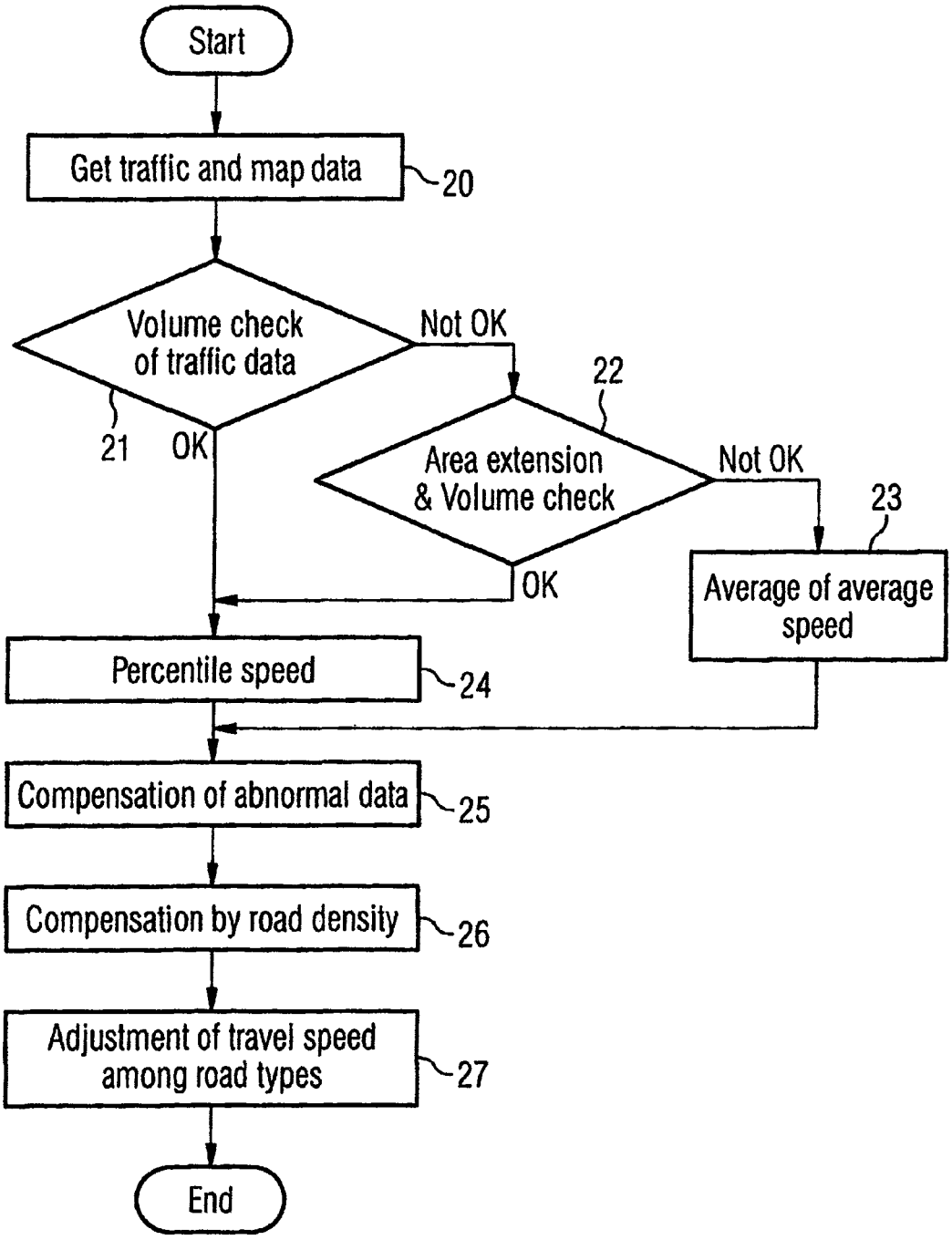
FIG. 2 is flow chart representing a speed data estimation unit of the traffic information providing system according to FIG. 1.

FIG. 2 shows a flow chart of the processing performed in the speed data estimation unit 13. In a first step (Step 20), the traffic data and map data is obtained by the data getting unit 130. In a second step (Step 21), the volume of the traffic information data available in a given target area (FIG. 3) is checked. The volume check of the traffic data is performed for each road type and each number of lanes individually. The different road types include national and international motorways, national and international highways, district roads, arterial roads, basic roads and ferry routes. If a travel speed estimate for a link representing a road of the same road type, e.g. an international highway with two lanes, is sought, the data volume check unit checks if within the given target area, there is sufficient traffic data for this road type, in the above example for international highways with two lanes. If on the other hand the speed data estimation unit 13 is estimating speed data e.g. for a link corresponding to a district road, the data volume check unit checks whether there is sufficient travel data of district roads within the given target area.

The data volume check unit 131 calculates the necessary number N of data points from a T distribution table depending on a confidence interval $\alpha$, a standard deviation of speeds in an area, an average speed in an area such that a given target accuracy (e.g. 10%) for the speed estimate is achievable. The volume check is performed based on the traffic data volume at midnight or, in other words, for free traffic conditions in every area, for every road type and for every number of lanes.

If the available volume of traffic data exceeds a predetermined threshold calculated as described above, it is judged as "OK". If the volume is not sufficient, such that a statistical processing would result in an accuracy below the desired target accuracy, the data volume check unit adapts the size of the target area depending on the amount of available traffic information data. The adaption of the size of the target area is performed by increasing the size of the target area stepwise (FIG. 3), until the available data volume within the increased target area is either sufficient or until an upper limit of the area extension is reached. The parameter for the upper limit of the area extension and the parameter for judging the sufficiency of data volume are determined in advance. For typical applications in Central Europe, the upper limit for the area extension corresponds e.g. to a few tens of kilometers. The initial target area corresponds to one level 1 mesh. The meshes are defined depending on the geographic latitude and longitude and essentially correspond to squares with edges of e.g. roughly 2.5 kilometers. Level 2 meshes have edges with a length of e.g. roughly 10 kilometers.

The data volume check unit 131 sends the result of the data volume check (OK/NOT OK) to the speed processing unit 132 (Step 22).

Figure 3:
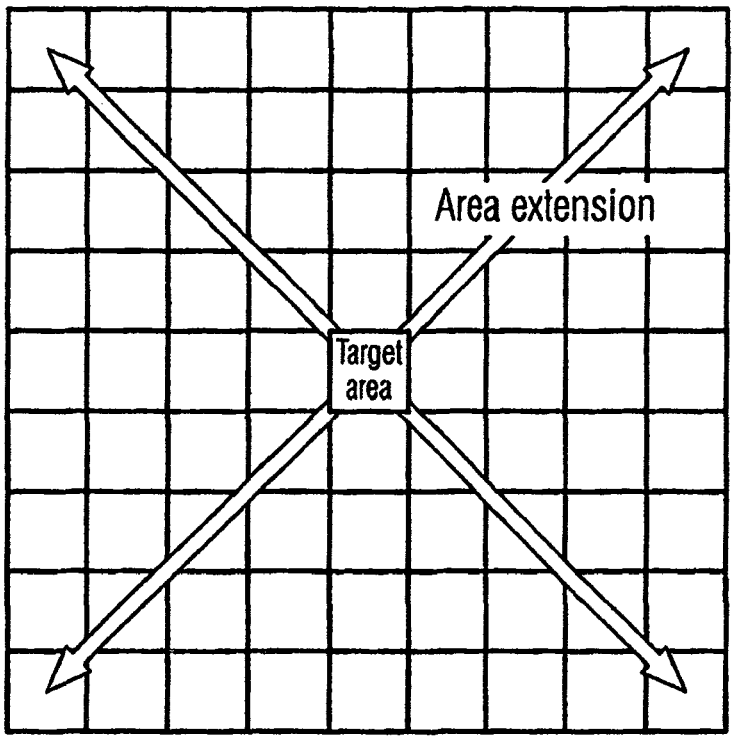
FIG. 3 is a schematic representation of a target area extension for adapting a size of the target area as performed by a data volume check unit of the speed data estimation unit of FIGS. 1 and 2.

As shown in FIG. 3, the area extension is performed by including level 1 meshes neighboring the previous target area into an increased area, such that the original or initial target area always remains in the center of the extended target area.

The speed processing unit 132 tentatively determines the speed in free traffic flow conditions. If the volume check unit is "NOT OK", even if the upper limit for the area extension is reached, the speed processing unit calculates an average speed on the area, road type and number of lanes by averaging the average speeds obtained from the map data stored in the map data base (Step 23). On the other hand, if the data volume check unit 131 has sent a result "OK", the speed processing unit 132 processes the traffic data statistically by estimating the travel speed for the link where no real traffic data is available from available traffic data relating to the same or similar road types within the same target area.

The statistical processing is performed by calculating the percentile speed determined in advance. Refer to the Step 24. The speed processing unit 132 arranges the available speed data points in an ascending order and selects the $85^{th}$ percentile speed. By doing so, the influence of isolated abnormally high speed data points is excluded.

The selected tentative speed is sent to a speed compensation unit 133 which compensates the tentative speed data calculated by the speed processing unit 132. The speed compensation unit 133 executes three compensation methods.

Figure 4:
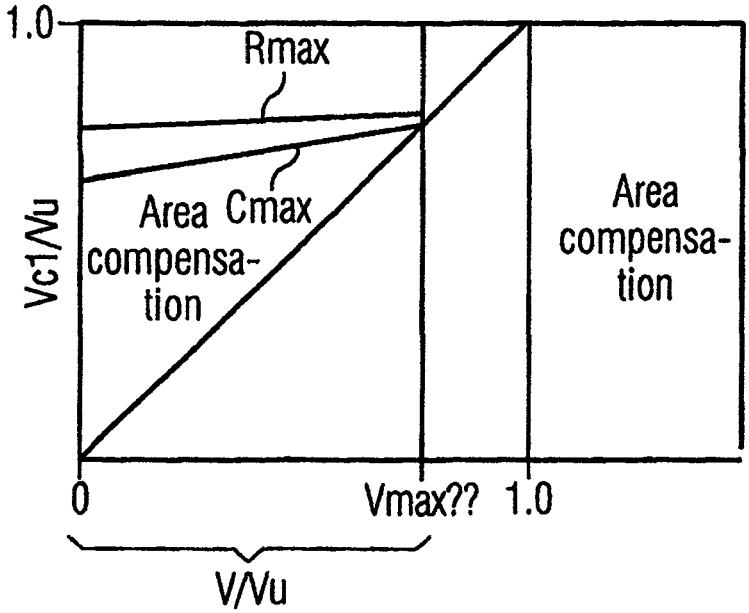
FIG. 4 is a graph of a first compensation function for the compensation of abnormal data.

The first method is compensation of abnormal data. Refer to the Step 25 of FIG. 2. The method, if the ratio of tentative speed V to upper limit speed Vu is less than a predetermined threshold Rmax (<1.0), the speed V is compensated as Vc1 in the way as shown in FIG. 4. Cmin is a parameter of minimum ratio of compensated speed Vc1 to the upper limit speed Vu and it should be less than Rmax. The upper limit speed Vu depends on the road type and is determined in advance.

As shown in FIG. 4, the correction function is a monotonically increasing function with values between the lower speed limit (Rmax·Vu) and the upper speed limit (Vu). The correction function is equal to the identity function for values of the tentative speed between a first threshold Rmax·Vu and the upper speed limit Vu. The correction function is a piecewise linear function.

The second method is a compensation by road density. Refer to the Step 26 of FIG. 2. The speed compensation unit 133 is configured to calculate a characteristic value ($a_m$, $k_m$) for a road density within the initial target area or within the extended target area comprising the specific link and determines a correction function depending on the characteristic value $a_m$. The compensated speed Vc2 is calculated by compensating the speed value V by multiplying V with the factor $a_m$.

$$Vc2=a_m \cdot V$$

Figure 5:
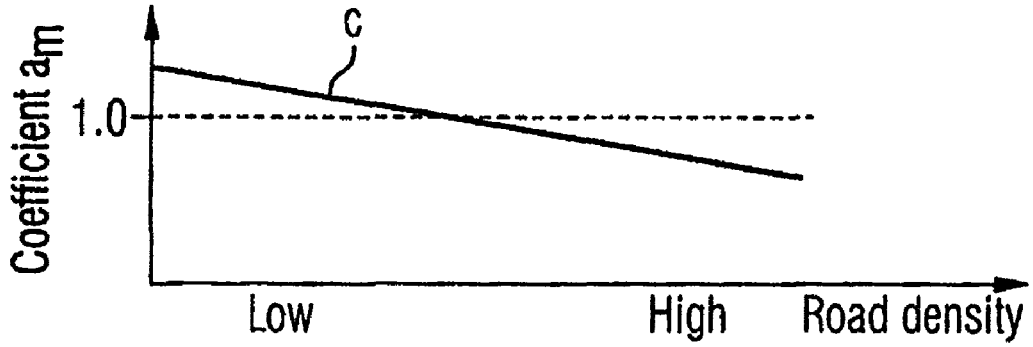
FIG. 5 is a graph of a second compensation function representing a relationship between a road density and a coefficient for compensation.

Here, the speed V is the speed compensated by the compensation function according to FIG. 4. The compensation parameter $a_m$ is defined as a linear function of the road density $K_m$, which is calculated as shown in FIG. 5. The function $a_m$ decreases with increasing $K_m$.

$$a_m=b \cdot k_m+c$$

The parameters b and c for this linear function are predetermined using a statistical optimization method (e.g. least square method) using real traffic data. The above function is shown in FIG. 5.

Road density $K_m$ is calculated in the following way. (See FIG. 6)

(i) Target area is divided into some grids.

(ii) Label of grids in which straight line of both end-points of the link is involved is set 1. If the straight line passes on lattice point, label of all the next grids (4 grids) of the lattice point is set 1. (Grids 53 in FIG. 6)

(iii) Label of several grids next from the grid of label 1 is set 2. (Grids 54 in FIG. 6) However, label of grid whose label has been 1 is not changed.

(iv) Road density $K_m$ is calculated in equation (3).

$$Km=(\Sigma Li)/(S1+S2) \quad (3)$$

L is length of link i. S1 and S2 is respectively superficial content of label 1 and 2.

Figure 6:
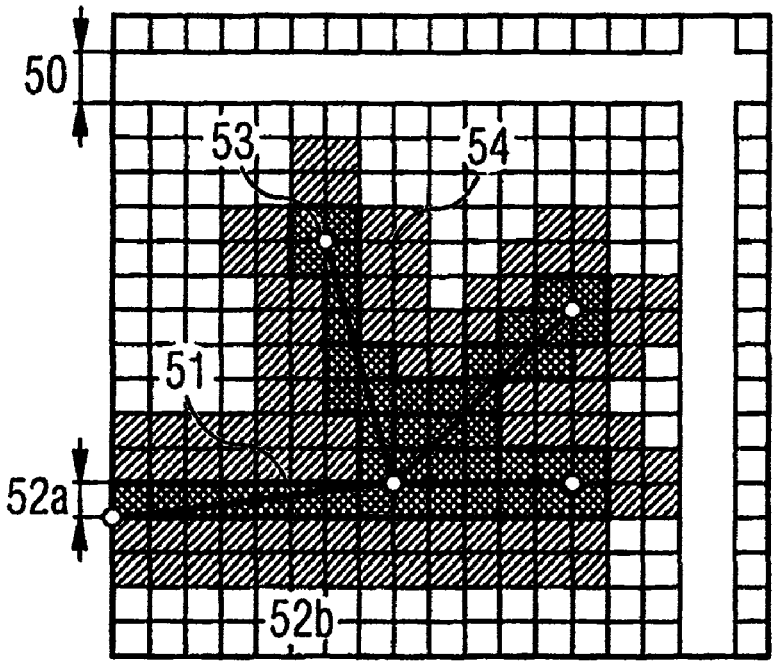
FIG. 6 is a schematic representation illustrating a calculation of a road density as carried out by a speed compensation unit of the speed data estimation unit according to FIG. 1.

The characteristic value $K_m$ is calculated in a way schematically illustrated in FIG. 6. First, the target area is divided into grids. Second, each of the meshes of the grid, where a straight line connecting the endpoints of the links passes through, is assigned to a first weight factor (e.g. 1). If the straight line passes a lattice point, the grid meshes neighboring the lattice point are set to the first weights. The meshes which are weighted with the first weight factor are dashed in FIG. 6.

Subsequently, in the third step, the meshes of the grid neighboring a mesh assigned with a first weight factor are assigned to a second weight factor. In the present embodiment, the first weight factor is 1 and the second weight factor is 2. If the mesh has been assigned to the first weight factor in the second step, its weight is not changed in the first step. Finally, the road density $K_m$ is calculated. In order to do so, the sum of all weight factors of all meshes within the target area is calculated. The sum may be written as $S_1+S_2$, wherein $S_1$ is the sum of all meshes associated with the first weight, and wherein $S_2$ is the sum of all meshes associated to the second weight. Moreover, the sum of the length of all links within the target area is calculated. The characteristic value $K_m$ for the road density is calculated as a fraction of the sum of the length of the links and the sum of the weight factors.

$$K_m = \frac{\sum L_i}{S_1 + S_2}$$

wherein $L_i$ is the length of the link i.

In a third method, the travel speeds are adjusted among the different road types. The adjustment is performed in one target area according to a predetermined speed rank order of road types. Refer to the Step 27 of FIG. 2.

| Road Type | Road Type ID | Speed Rank Order |
|---|---|---|
| Motorway (International & Intercity) | 1 | 1 |
| Motorway (National & Others) | 2 | 2 |
| Highway (International & Intercity | 3 | 3 |
| Highway (National & Others) | 4 | 4 |
| Other Roads (District) | 5 | 5 |
| Other Roads (Arterial) | 6 | 6 |
| Other Roads (Basic) | 7 | 7 |
| Ferry Route | 8 | 8 |

Figure 7:
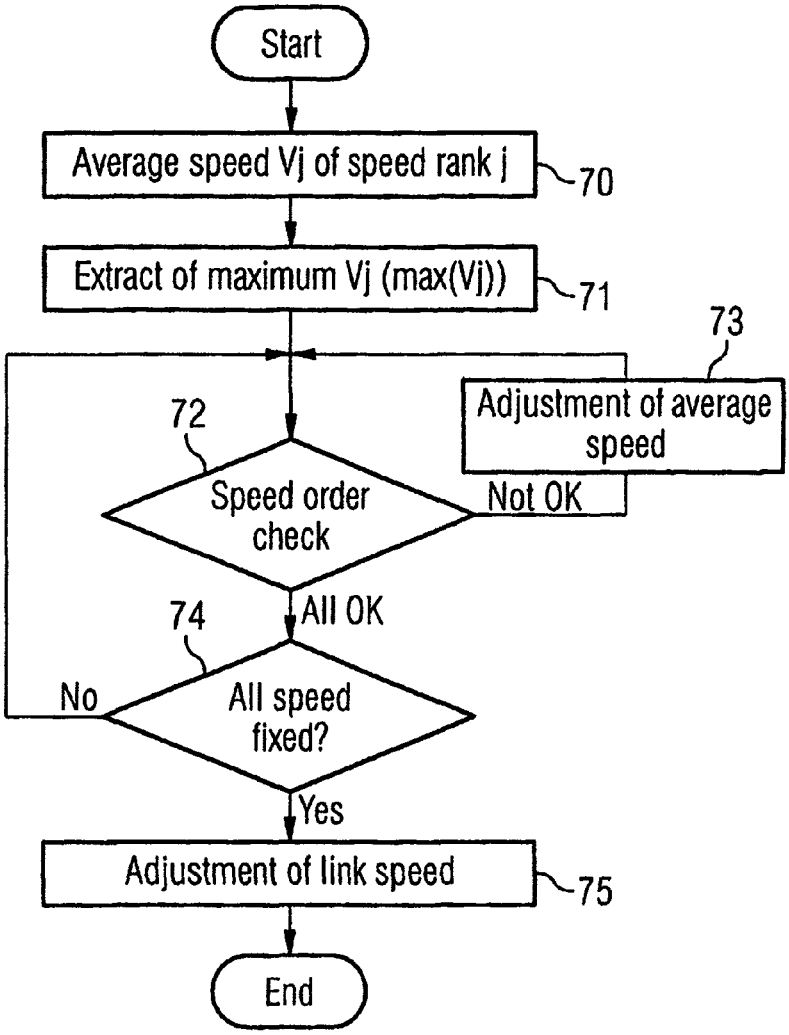
FIG. 7 is a flow chart representing the method for adjusting travel speeds among different road types.

FIG. 7 is a flow chart of the processing performed by the speed adjustment unit of the speed data estimation according to FIG. 1. In a first step 70, the speed adjustment unit calculates the average speed Vj of a given road type of a speed rank j for each number of lanes and for each area. For averaging, the speed compensation unit 133 may use the compensated speed values according to the above methods or may use, in alternative embodiments, the original speeds as obtained from the traffic data base 11.

In a next step (Step 71), a maximum speed of all calculated average speeds within a given area is extracted. In the Step 72, the speed compensation unit 133 compares the maximum speed $\max(V_j)$ with all calculated average speeds $V_k'$. If the maximum speed is not the speed for roads of speed rank order 1, namely for international and intercity motorways, in the Step 73, $V_k$ and $\max(V_j)$ are adjusted according to the following equations:

$$V_k' = \frac{V_k + \max(V_j) + \Delta V}{2}$$

-continued $$V_j' = \frac{V_1 + \max(V_j) + \Delta V}{2}$$

Essentially, the order of the average speed of the road with the highest speed rank and of the average speed corresponding to the maximum average speed are exchanged in a way that the sum of the two speed values is kept constant and that a predetermined speed margin Δv (e.g. 2 km/h) is maintained. If the maximum speed corresponds to the speed associated to the road type or at the highest speed rank value, the latter speed is fixed and the above described procedure is repeated with the remaining speed values, until all average speeds are fixed. Refer to Step 74.

Finally, the speed compensation unit 133 determines a ratio of the adjusted average speeds and the original average speeds for each road type and for each number of lanes and adjusts the speed values for each link of the same road type and of the same number of lanes in the same target area by multiplying the speed value with the ratio of the adjusted average speed and the original average speed. If e.g. the adjusted average speed of a district road is 20% higher than the originally calculated average speed for district roads within the given target area, the speed values associated to all the district roads within the target area are increased by 20%. The adjusted link speed as calculated by multiplying the originally link speed resulting from the above speed compensation methods with the calculated ratio. In other words, the link speed is compensated using an average compensation of the entire target area. Refer to Step 75.

The above described travel information providing system implements a corresponding method for generating traffic information and provides accurate travel speed for all links for free traffic flow conditions. If the travel speed is applied to a travel planning system such as a car navigation system or a truck management system, the quality of route and the predicted arrival time provided by the systems is highly improved. Because the accuracy of the travel speed is improved where no data is provided, the total travel time for routes including covered links and non-provision links is improved, compared with conventional systems.

Figure 8:
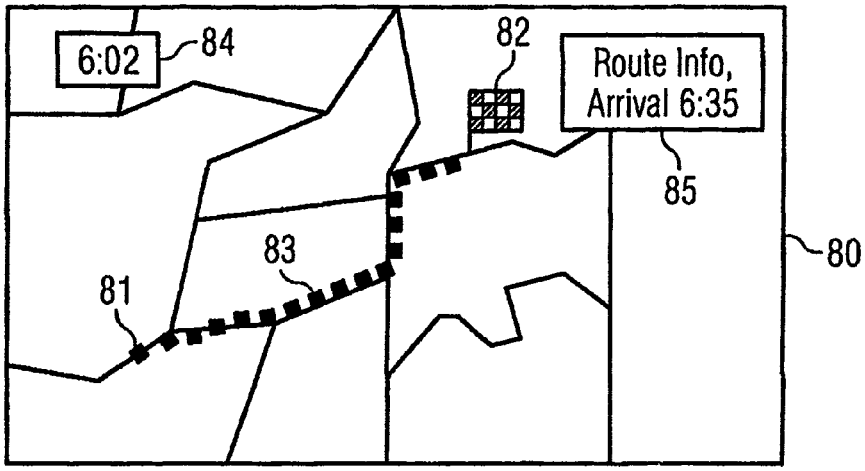
FIG. 8 is a sample of a route and predicted arrival time provided by a car navigation system according to the invention.

A sample of a route and a predicted arrival time provided by the car navigation system is shown in FIG. 8. The car navigation system comprises a display 80, representing a current location 81 and a destination 82, together with a route 83 calculated by the car navigation system based on the speed data as calculated by the speed data estimation unit 13. Moreover, the display 80 shows the current time 84 and route information 85 including a predicted arrival time.

Moreover, the car navigation system uses the travel speed calculated by the speed data estimation unit 13 for free traffic flow conditions for estimating a traffic speed for congested traffic flow conditions. Since a precision of the estimate for free traffic flow conditions is improved, the resulting estimation error in the congested traffic flow condition estimate may be highly decreased.

The above traffic information providing system and the above method for generating traffic information enhances the quality of the results of a route search algorithm. The invention accurately estimates travel speeds on all road sections in free traffic flow conditions using real traffic data, whereas data obtained from road traffic sensors or limiting speed may be avoided.

The invention enables to estimate accurate travel speeds on all road sections in free traffic flow conditions. The estimated speed for free traffic flow conditions is available for accurate estimation in congested traffic flow as well. Car navigation systems or truck planning systems can improve the quality of routes and the accuracy of the arrival time estimates by using the estimated speed data for route search.

The above features of the embodiment may be combined in any suitable way partly or as a whole.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A method for generating traffic information to be used in a car navigation system, comprising the steps of:

acquiring traffic information data including information relating to a travel time of links making up a road on a map and for acquiring map data relating to the link, said map data comprising at least information on a road type of the link;

checking if a volume of the traffic information data available in is sufficient for performing a statistical estimate for the travel time;

checking if the volume of traffic information data relating to links located in a target area is sufficient; and adapting a size of the target area depending on the amount of available traffic information data; and further comprising a speed processing step for determining a travel speed of a specific link by extracting and evaluating the traffic information data relating to links of the same or similar road type and being located in the same target area as the specific link;

wherein in said speed processing step, if an amount of the extracted traffic information data in the target area before the size is increased or after the size is increased is sufficient, a predetermined percentile speed is selected from a distribution of speed values of the extracted traffic information data extracted from said traffic information data and relating to links of the same or similar road type and being located in the same target area as the specific link and the value of a tentative speed on the specific link is set to be equal to the value of said predetermined percentile speed, if the amount of the extracted traffic information data in the target data after the size is increased is insufficient, an average speed of the distribution of the speed values relating to the specific link located in the target area is set to be the value of the tentative speed on the specific link.

2. A method for generating traffic information to be used in a car navigation system, comprising the steps of:

acquiring traffic information data including information relating to a travel time of links making up a road on a map and for acquiring map data relating to the link, said map data comprising at least information on a road type of the link;

checking if a volume of the traffic information data available in is sufficient for performing a statistical estimate for the travel time;

checking if the volume of traffic information data relating to links located in a target area is sufficient; and adapting a size of the target area depending on the amount of available traffic information data; and further comprising a speed compensation step, wherein a tentative speed value determined from a distribution of speed values extracted from said traffic information data is subjected to at least one correction function;

wherein said correction function is a monotonically increasing function with values between a lower speed limit and an upper speed limit.

3. A method for generating traffic information to be used in a car navigation system, comprising the steps of:

acquiring traffic information data including information relating to a travel time of links making up a road on a map and for acquiring map data relating to the link, said map data comprising at least information on a road type of the link;

checking if a volume of the traffic information data available in is sufficient for performing a statistical estimate for the travel time;

checking if the volume of traffic information data relating to links located in a target area is sufficient; and adapting a size of the target area depending on the amount of available traffic information data; and further comprising a speed compensation step, wherein a tentative speed value determined from a distribution of speed values extracted from said traffic information data is subjected to at least one correction function;

wherein in said speed compensation step, a characteristic value for a road density within an area comprising the specific link is calculated and the correction function is determined depending on said characteristic value.

4. A method for generating traffic information to be used in a car navigation system, comprising the steps of:

acquiring traffic information data including information relating to a travel time of links making up a road on a map and for acquiring map data relating to the link, said map data comprising at least information on a road type of the link;

checking if a volume of the traffic information data available in is sufficient for performing a statistical estimate for the travel time;

checking if the volume of traffic information data relating to links located in a target area is sufficient; and adapting a size of the target area depending on the amount of available traffic information data; and further comprising a speed compensation step, wherein a tentative speed value determined from a distribution of speed values extracted from said traffic information data is subjected to at least one correction function;

wherein said speed compensation step comprises the step of subsequently applying at least a first correction function and a second correction function to the tentative speed value.

5. A method for generating traffic information to be used in a car navigation system, comprising the steps of:

acquiring traffic information data including information relating to a travel time of links making up a road on a map and for acquiring map data relating to the link, said map data comprising at least information on a road type of the link;

checking if a volume of the traffic information data available in is sufficient for performing a statistical estimate for the travel time;

checking if the volume of traffic information data relating to links located in a target area is sufficient; and adapting a size of the target area depending on the amount of available traffic information data; and further comprising a speed compensation step, wherein a tentative speed value determined from a distribution of speed values extracted from said traffic information data is subjected to at least one correction function; and a speed adjustment step, wherein average speeds of different road types within the same area are compared and wherein the average speeds are adjusted if the comparison yields an unexpected result.

6. The method according to claim 5, wherein said speed adjustment step comprises the step of determining a ratio of the adjusted average speed and the original average speed for each road type and the step of adjusting the speed values for each link of the same road type in the same area by multiplying the speed values with the ratio.

7. A traffic information providing device that generates traffic information for a car navigation system, comprising:

a data getting unit that acquires traffic information data including information relating to a travel time of links making up a road on a map and map data relating to the link, the map data comprising at least information on a road type of the link;

a data volume check unit that determines whether a volume of the traffic information data is sufficient for performing a statistical estimate for the travel time, determines whether the volume of traffic information data relating to links located in a target area is sufficient, and adapts a size of the target area depending on the amount of available traffic information data; and a speed compensation unit, in which a tentative speed value determined from a distribution of speed values extracted from the traffic information data is subjected to at least one correction function;

wherein the correction function is a monotonically increasing function with values between a lower speed limit and an upper speed limit.

8. A traffic information providing device that generates traffic information for a car navigation system, comprising:

a data getting unit that acquires traffic information data including information relating to a travel time of links making up a road on a map and map data relating to the link, the map data comprising at least information on a road type of the link;

a data volume check unit that determines whether a volume of the traffic information data is sufficient for performing a statistical estimate for the travel time, determines whether the volume of traffic information data relating to links located in a target area is sufficient, and adapts a size of the target area depending on the amount of available traffic information data; and a speed compensation unit, in which a tentative speed value determined from a distribution of speed values extracted from the traffic information data is subjected to at least one correction function;

wherein, in the speed compensation unit, a characteristic value for a road density within an area comprising the specific link is calculated and the correction function is determined depending on the characteristic value.

9. A traffic information providing device that generates traffic information for a car navigation system, comprising:

a data getting unit that acquires traffic information data including information relating to a travel time of links making up a road on a map and map data relating to the link, the map data comprising at least information on a road type of the link;

a data volume check unit that determines whether a volume of the traffic information data is sufficient for performing a statistical estimate for the travel time, determines whether the volume of traffic information data relating to links located in a target area is sufficient, and adapts a size of the target area depending on the amount of available traffic information data; and a speed compensation unit, in which a tentative speed value determined from a distribution of speed values extracted from the traffic information data is subjected to at least one correction function;

wherein the speed compensation unit subsequently applies at least a first correction function and a second correction function to the tentative speed value.

10. A traffic information providing device that generates traffic information for a car navigation system, comprising:

a data getting unit that acquires traffic information data including information relating to a travel time of links making up a road on a map and map data relating to the link, the map data comprising at least information on a road type of the link;

a data volume check unit that determines whether a volume of the traffic information data is sufficient for performing a statistical estimate for the travel time, determines whether the volume of traffic information data relating to links located in a target area is sufficient, and adapts a size of the target area depending on the amount of available traffic information data;

a speed compensation unit, in which a tentative speed value determined from a distribution of speed values extracted from the traffic information data is subjected to at least one correction function; and a speed processing unit, in which average speeds of different road types within the same area are compared and the average speeds are adjusted if the comparison yields an unexpected result.

11. The traffic information providing device of claim 10, wherein the speed processing unit determines a ratio of the adjusted average speed and the original average speed for each road type and the step of adjusting the speed values for each link of the same road type in the same area by multiplying the speed values with the ratio.

* * * * *